US010072452B2

(12) United States Patent
Carrier

(10) Patent No.: US 10,072,452 B2
(45) Date of Patent: Sep. 11, 2018

(54) WINDOW OPERATOR

(71) Applicant: Christian Carrier, L'Ancienne-Lorette (CA)

(72) Inventor: Christian Carrier, L'Ancienne-Lorette (CA)

( * ) Notice: Subject to any disclaimer, the term of this patent is extended or adjusted under 35 U.S.C. 154(b) by 0 days.

(21) Appl. No.: 14/756,813

(22) Filed: Oct. 16, 2015

(65) Prior Publication Data

US 2017/0107750 A1 Apr. 20, 2017

(51) Int. Cl.

| | |
|---|---|
| ***E05D 15/28*** | (2006.01) |
| ***E05F 11/16*** | (2006.01) |
| ***E05C 9/04*** | (2006.01) |
| ***E05B 13/00*** | (2006.01) |

(52) U.S. Cl.
CPC ..... *E05F 11/16* (2013.01); *E05B 13/00* (2013.01); *E05C 9/041* (2013.01)

(58) Field of Classification Search
CPC ..... E05F 11/16; E05C 9/041; E05B 13/00
USPC ..... 49/246, 148, 249, 395
See application file for complete search history.

(56) References Cited

U.S. PATENT DOCUMENTS 4,143,556 A * 3/1979 Hauber ..... E05F 11/24 49/324
4,392,329 A * 7/1983 Suzuki ..... E05C 17/32 49/356
5,152,103 A * 10/1992 Tucker ..... E05F 11/16 49/279
5,509,234 A * 4/1996 Klimek ..... E05F 11/16 49/342
5,531,045 A * 7/1996 Piltingsrud ..... E05F 11/34 49/279
5,775,028 A * 7/1998 Lambert ..... E05D 15/30 49/246
5,815,984 A * 10/1998 Sheets ..... E05F 11/16 49/246
5,839,229 A * 11/1998 Briggs ..... E05F 11/14 49/246
5,927,767 A * 7/1999 Smith ..... E05C 9/063 292/139
6,122,863 A * 9/2000 Tippin ..... E05F 11/16 49/279
6,135,511 A * 10/2000 Smith ..... E05C 9/063 292/139
6,283,516 B1 * 9/2001 Viney ..... E05B 15/004 292/160
7,004,515 B2 * 2/2006 Timothy ..... E05C 9/185 292/137

(Continued)

FOREIGN PATENT DOCUMENTS

FR 2982306 A1 * 5/2013 ..... E05C 9/021

*Primary Examiner* — Jerry E Redman
(74) *Attorney, Agent, or Firm* — Eric Fincham

(57) ABSTRACT

An operator for a window comprising a base designed to be secured to a window sash, an arm having first and second ends with the first end being secured to the base and a first end of the arm having a worm wheel formed thereon, a shaft having a worm operatively connected to the worm wheel, a handle secured to the shaft, a locking mechanism comprising a multipoint tie bar, and an actuator connected to a rack and pinion gear arrangement to move the multipoint tie bar between open and locked positions. The arrangement provides for a compact efficient design which includes a locking mechanism and an opening mechanism located at the same point.

10 Claims, 13 Drawing Sheets

(56) References Cited

U.S. PATENT DOCUMENTS

| | | | | |
|---|---|---|---|---|
| 7,708,322 | B2 * | 5/2010 | Timothy | E05C 9/063 292/137 |
| 8,434,265 | B1 * | 5/2013 | Campbell | E05D 15/30 16/195 |
| 8,555,548 | B2 * | 10/2013 | Carter | E05C 9/08 49/246 |
| 8,683,746 | B2 * | 4/2014 | Lambertini | E05F 11/10 49/246 |
| 9,003,706 | B2 * | 4/2015 | Meves | E05B 65/0025 49/246 |
| 9,273,763 | B2 * | 3/2016 | Evensen | F16H 21/44 |
| 2002/0066162 | A1 * | 6/2002 | Klompenburg | E05F 11/16 16/429 |
| 2002/0124468 | A1 * | 9/2002 | Manzella | E05F 11/16 49/336 |
| 2003/0029091 | A1 * | 2/2003 | Renz | E05D 15/52 49/246 |
| 2003/0110701 | A1 * | 6/2003 | Dawson | E05F 11/16 49/246 |
| 2004/0183314 | A1 * | 9/2004 | Klompenburg | E05C 9/02 292/263 |
| 2004/0244296 | A1 * | 12/2004 | Dinkelborg | E05C 9/041 49/449 |
| 2005/0055804 | A1 * | 3/2005 | Liang | E05D 7/0415 16/235 |
| 2006/0260099 | A1 * | 11/2006 | Liang | E05F 11/00 16/429 |

* cited by examiner

Fig. 3a
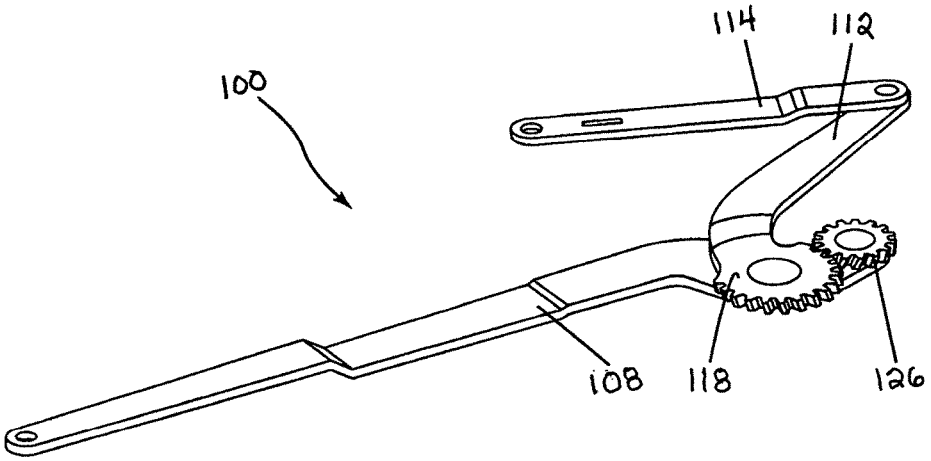
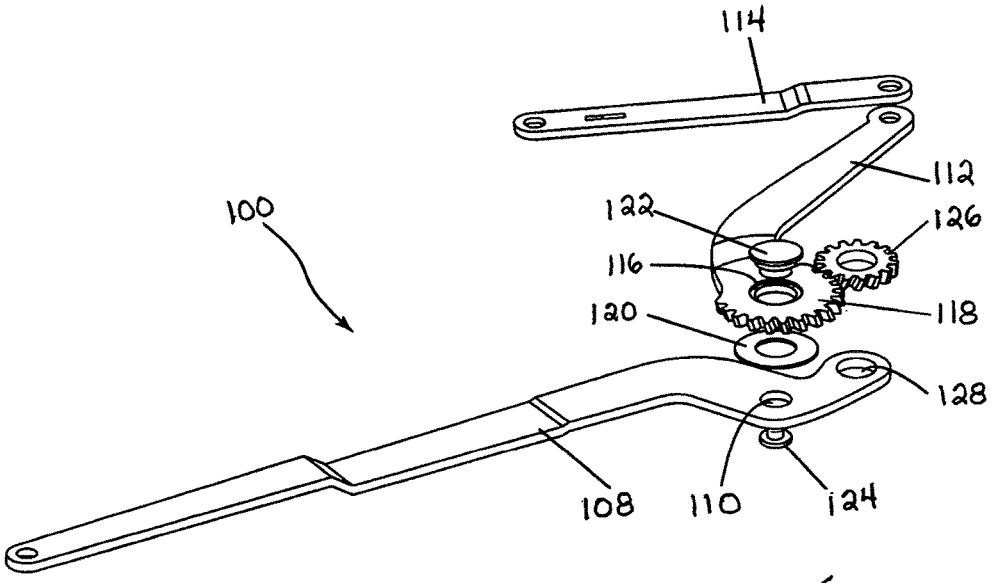
Fig. 3b

WINDOW OPERATOR

FIELD OF THE INVENTION

The present invention relates to windows, and more particularly, relates to window operators such as may be used in a casement windows or alternatively, in awning windows.

BACKGROUND OF THE INVENTION

Casement windows are well known in the art and are widely used in new constructions. A casement window is hinged at the side and has a window sash which is movably mounted within a frame by a pair of hinges mounted between the window frame at the top and bottom of the window sash. The arrangement is normally one in which a track is mounted to the window frame to interconnect a track and window sash. In this respect, a support arm is pivotably connected to the sash arm and to the track. The sash arm is also pivotably connected to a mounting shoe which is supported and guided for movement lengthwise of the track which is mounted on the window.

An alternative arrangement is to provide an intervening length between the sash arm and the movable shoe to provide for an offset sash arm. Such an arrangement typically includes a second intervening length between the support arm and the movable shoe to provide further support.

An awning window, on the other hand, is pivoted at the top by hinges. Such an arrangement is desirable in certain situations since the window pivots outwardly from the bottom and will remain in a position to shelter or shield the opening.

Casement window operators are also well known in the art. The window operator typically will utilize a hand crank which is rotatable and which in turn drives a worm gear. The worm gear in turn will drive gearing which is connected to the arm which pushes the window sash open. As aforementioned, the worm gear assembly includes a gear shaft having the worm at one end with the other end extending outwardly through the housing to engage the crank.

As described above, there are different opening arrangements for casement windows. A first arrangement utilizes a single arm operator which has an arm which pivots about an axis that is fixed with respect to the window frame and worm gear. A remote end of the arm carries a bearing which slides in a track mounted on the underside of the sash. The known disadvantage of single arm operators is the torque required to move the sash towards its fully open position. Thus, the force required both causes difficulty for the person opening the window and also leads to excessive wear of the mechanism.

A second known type of casement window operator is typically known as a "split arm". A split arm operator includes a second arm which has a pivot point in the middle of the second arm and the remote end of the second arm is secured through a pivotable mounting to a fixed point on the sash. This arrangement allows the window to extend to its fully open position. However, it does suffer from the disadvantage of requiring excessive force at the time of the initial opening of the sash.

A third type of window operator is typically known as a "dual arm". The dual arm operator has one arm which rotates about a fixed axis and a housing which carries at its far end a bearing to slide in a track mounted to the window sash.

There is also a second arm which has a pivot joint and which is secured at its remote end by a pivotable but fixed connection to the sash.

SUMMARY OF THE INVENTION

It is an object of the present invention to provide improvements to casement window operators wherein on site adjustments may easily be made.

It is a further object of the present invention to provide window operators which include a locking mechanism.

It is a further object of the present invention to provide a locking mechanism which ensures that the window operator is not utilized until the window is unlocked.

It is a further object of the present invention to provide a window operator for an awning window which allows identical movement on both sides of the window.

According to a further aspect of the present invention, there is provided an operator for a window comprising a base designed to be secured to a window sash, an arm having first and second ends, the first end being secured to the base, the first end of the arm having a worm wheel formed thereon, a shaft having a worm operatively connected to the worm wheel, a handle secured to the shaft, a locking mechanism comprising a multi-point tie bar, and an actuator connected to a rack and pinion gear arrangement to move the multi-point tie bar between open and locked positions.

According to a still further aspect of the present invention, there is provided an operator for a window comprising a base designed to be secured to a window sash, an arm having first and second ends, the first end being secured to the base, the first end of the arm having a worm wheel formed thereon, a shaft having a worm operatively connected to the worm wheel, a handle secured to the shaft, a locking mechanism comprising a blade, a guide mounted on the sash, the blade being movable within the guide, and an actuator connected to the blade to move the blade between open and locked positions, the actuator, when in the locked position, preventing access to the handle, the actuator when moved to the open position allowing access to the handle.

In one of the above aspects, the operator is used with casement windows wherein the window is hinged on the side between the top and bottom of the window sash. The operator of the present invention may be utilized with a single arm, split arm or dual arm arrangement.

As mentioned above, the operator preferably utilizes a worm wheel or gear formed at a first end of an arm and which worm wheel is designed to engage a worm formed at one end of a shaft. The arm may be secured to the base by suitable securement members.

In one embodiment of the present invention, there is provided a multi point tie bar which is utilized in a locking mechanism. A locking mechanism is incorporated with the operator within the same housing. The locking mechanism is arranged such that the window must be unlocked prior to use of the window crank for opening of the window. This arrangement overcomes the problem of a user attempting to open the window while still locked. Frequently, excessive force is utilized by the person attempting to open the window which can lead to breakage of one or more of the components.

The locking mechanism should meet several standards for the industry. One requirement for many manufacturers is that integrated locking and opening mechanisms fit within pre-designed openings in the window. To do so, a compact design must be utilized. In the instant invention, the use of a rack and pinion gear allows for a compact design which also provides an arrangement which resists opening from the exterior of the window.

BRIEF DESCRIPTION OF THE DRAWINGS

Having thus generally described the invention, reference will be now made to the accompanying drawings illustrating embodiments thereof, in which:

FIGS. 3A and B are perspective views of a portion of an operator utilizing a double arm arrangement;

DETAILED DESCRIPTION OF THE INVENTION

Figure 1:
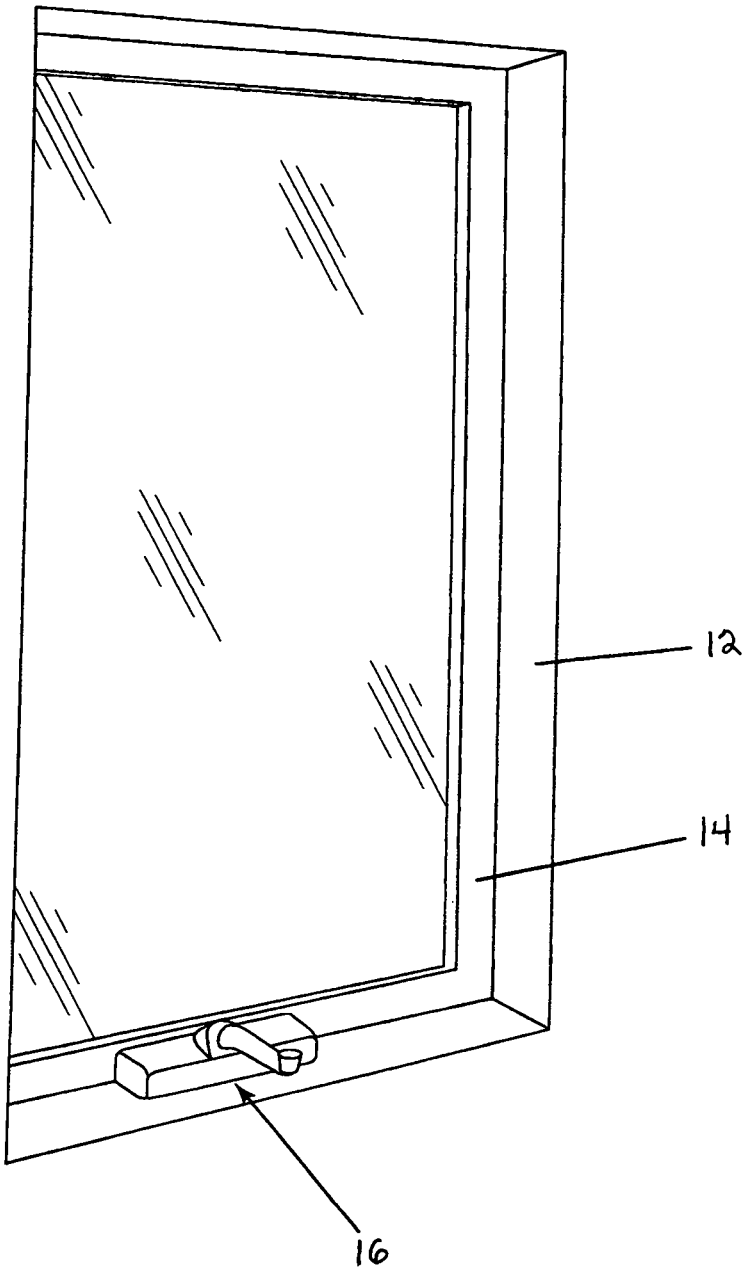
FIG. 1 is a perspective view of a window assembly using an operator.

Referring to the drawings in greater detail and by reference characters thereto, there is illustrated in FIG. 1 a window generally designated by reference numeral 10 and which window 10 includes a window frame 12 and a sash 14. An operator 16 is utilized to open and close a window which is of the casement type.

Figure 2A:
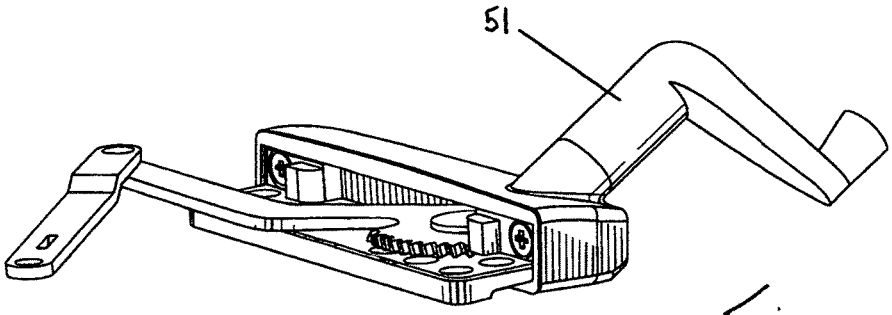
FIG. 2A is a perspective view of the window operator.
Figure 2B:
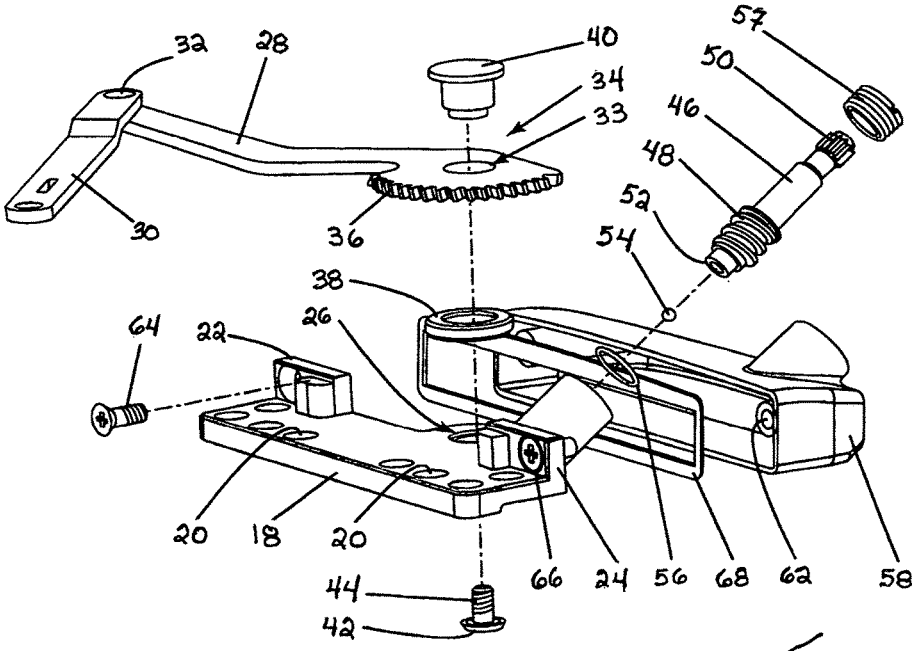
FIG. 2B is an exploded view thereof.

Operator 16, as may be better seen in FIGS. 2*a* and 2*b*, includes a base 18 which has a plurality of mounting apertures 20. As is conventional, base 18 may be secured to the window frame by screws or other suitable mechanical fasteners.

Mounted on the upper side of base 18 are posts 22 and 24 for reasons which will become apparent hereinbelow. Base 18 also has a aperture 26.

In the illustrated embodiment, operator 16 includes a first arm 28 and a second arm 30. Arms 28 and 30 are conventional in the art of window operators. Arms 28 and 30 are secured by rivet 32.

Arm 28 has a first end generally designated by reference numeral 34 and forms a portion of a worm wheel 36, as is well known in the art. It will be noted that there is provided an aperture 33 in worm wheel 36 and which aperture 33 overlies aperture 26. A shim 38 is placed between worm wheel 36 and base 18.

An upper securement member 40 works in conjunction with a lower securement member 42 to secure arm 28 in position. In this regard, upper securement member 40 has a threaded recess which is designed to screwthreadedly engage with threads 44 on lower securement member 42. In this arrangement, the lower securement member 42, upon tightening the same, draws upper securement member 40 downwardly into position to maintain a secure connection therebetween.

A shaft 46 has a worm 48 formed at one end thereof. At the opposed end, there is provided a spur gear 50 and worm screw 57 which is designed to engage with a handle 51.

Shaft 46, at the end proximate worm 48, has a recess 52 which is designed to receive a ball bearing 54 to allow for easy turning of shaft 46. A thermal seal 56 is also provided to prevent the passage of air from the interior of operator 16.

Operator 16 also includes a monocoque housing 58 which has two internally threaded cylinders 60, 62 which are designed to receive screws 64, 66 passing through post 22 and 24 to thereby mount the base 18 to the monocoque housing 58.

Ideally, a sealing member 68 is provided for thermal sealing against sash 14.

Figure 4:
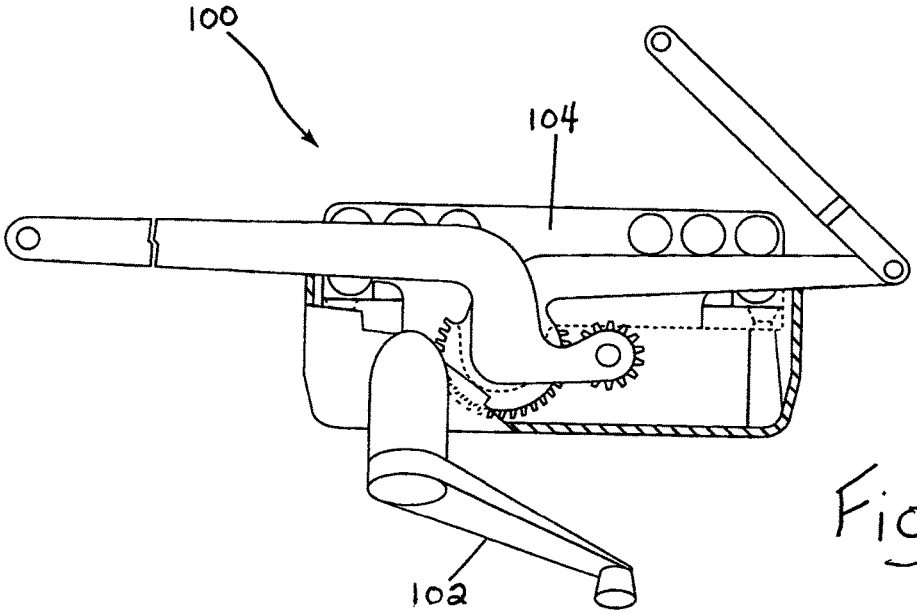
FIG. 4 is a top plan view of the operator of FIGS. 3A and 3B.
Figure 5:
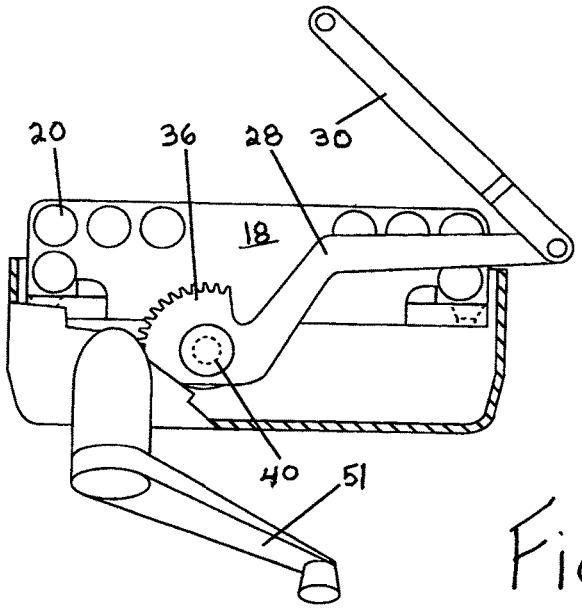
FIG. 5 is a top plan view of the operator of FIGS. 2A and 2B.

Turning to the embodiment of FIGS. 3A, 3B and 4, there is illustrated a double arm operator and which double arm operator is generally designated by reference numeral 100. Double arm operator 100 includes a handle 102 and a base 104 which has a plurality of mounting apertures 106.

A first arm 108 includes a mounting aperture 110 formed therein. A second arm 112 has a second arm extension 114 as in the previously described embodiment. A mounting aperture 116 is formed in the center of worm wheel 118. A shim 120 is mounted between second arm 112 and first arm 108. As in the previously described embodiment, there is provided an upper securement member 122 and a lower securement member 124 which are screwthreadedly engaged with each other.

In this embodiment, there is provided a second worm wheel 126 while as may be seen in FIG. 3B, there is provided an aperture 128 for mounting of worm wheel 126. In this regard, it may be mounted in the same manner as previously described with use of upper and lower securement members.

Figure 6:
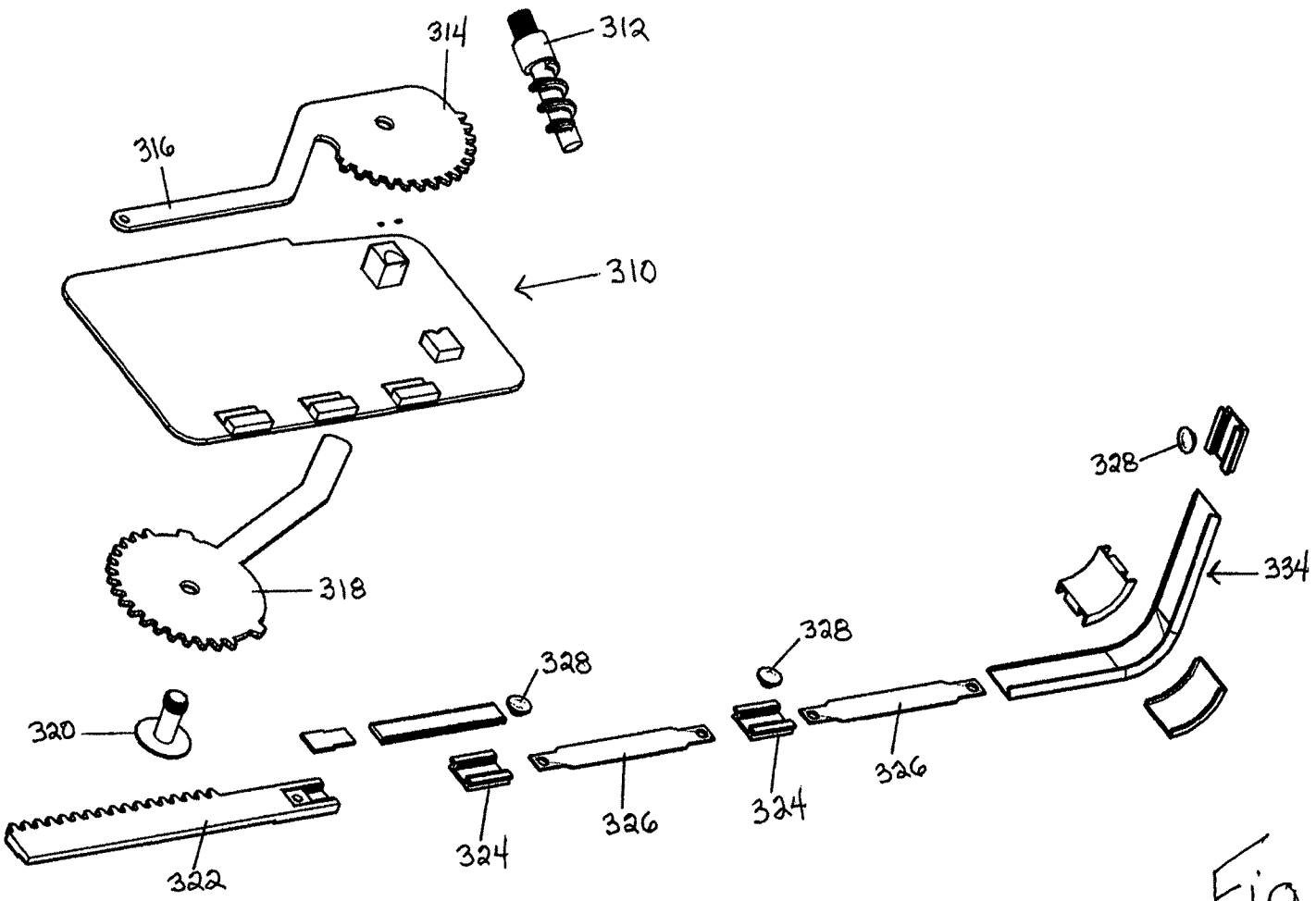
FIG. 6 is an exploded view of a portion of the window operator illustrating a locking system.
Figure 7:
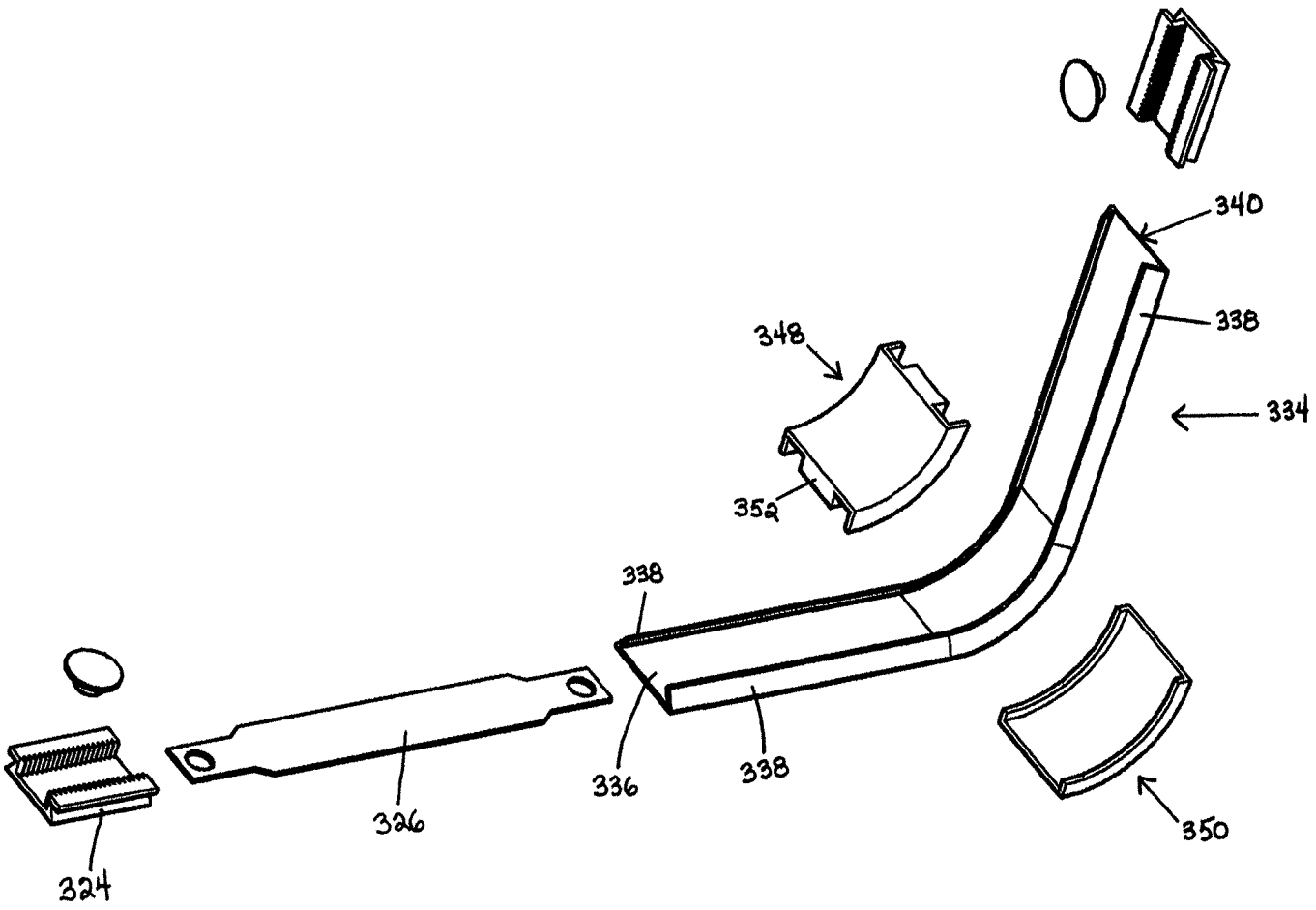
FIG. 7 is an exploded view of a portion of the locking system of FIG. 5.
Figure 8:
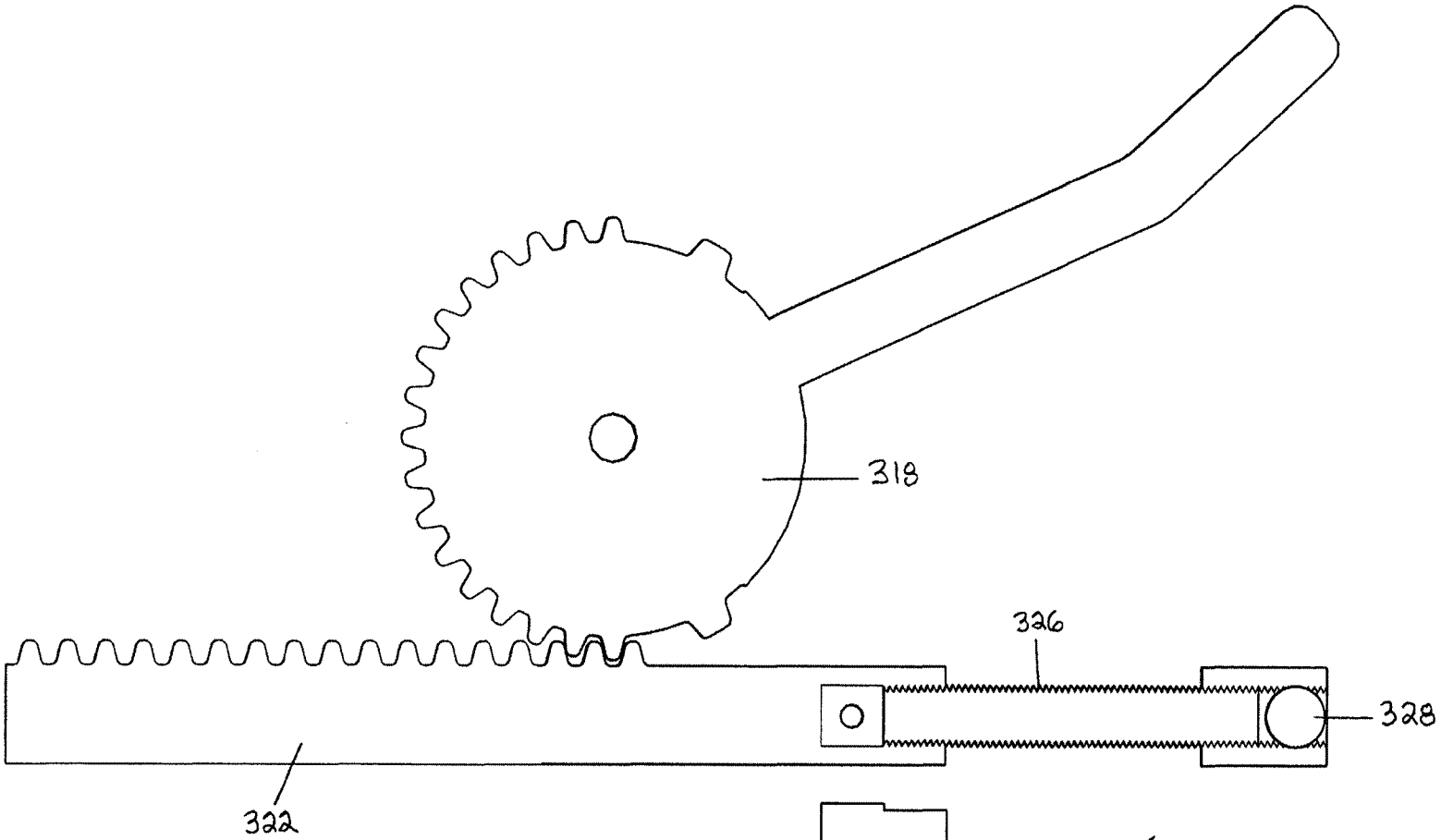
FIG. 8 is a partial plan view illustrating a portion of the locking system.
Figure 9:
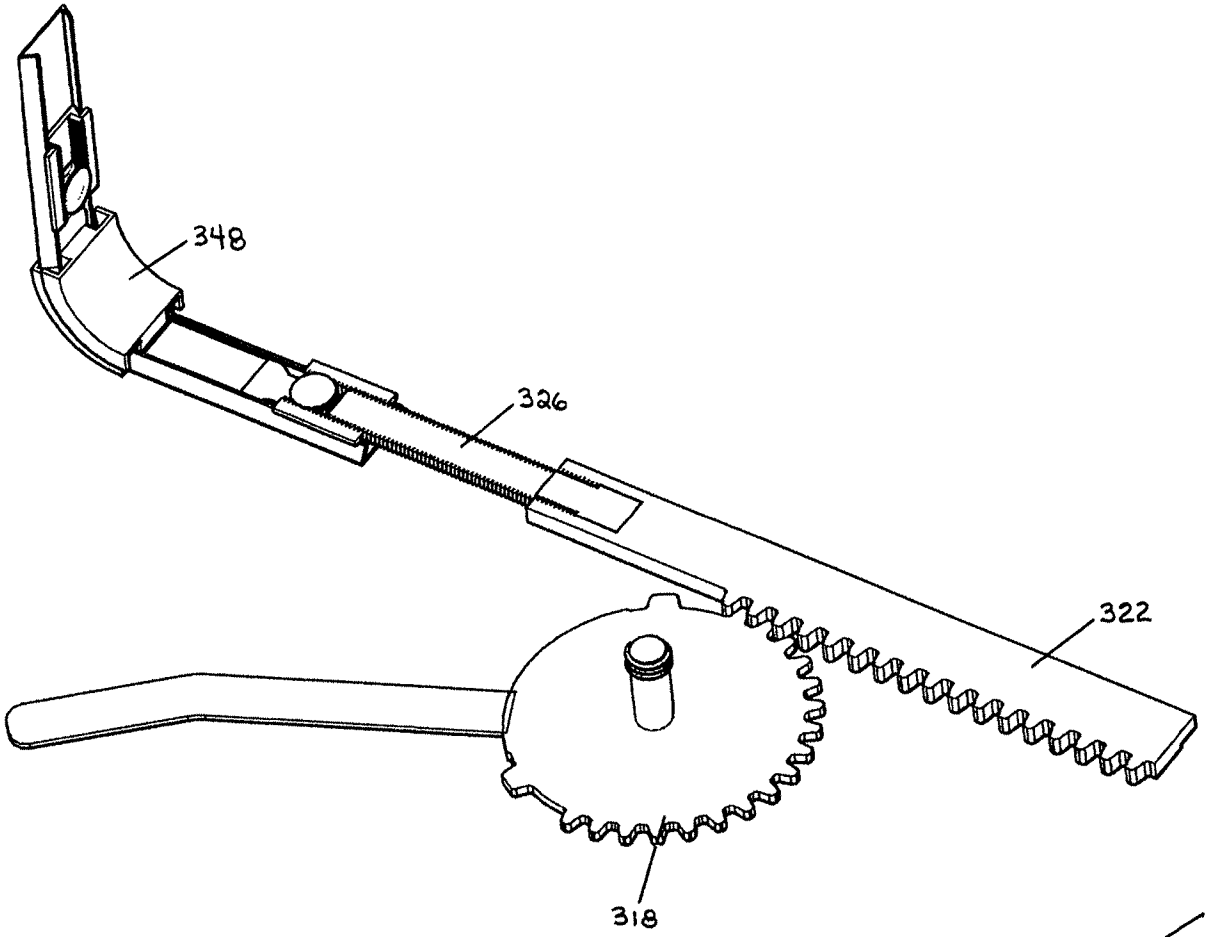
FIG. 9 is a perspective view thereof.

As may be seen in FIG. 6, in one embodiment of the present invention there is provided a plate 310. A worm 312 operates in conjunction with worm gear 314. An arm 316 is connected to worm gear 314 as in previously described embodiments.

There is also provided a pinion gear 318 and securement member 320. Pinion gear 318 is designed to mesh with rack gear 322.

The blade is formed of a plurality of blade members 326 and connectors 324 with plugs 328. In this arrangement, a series of precut blade members 326 may be arranged to have the desired length. The length will vary upon the size of the window.

The track includes a corner component generally designated by reference numeral 334. Corner component 334 has a base 336 and a pair of side walls 338 which are angled inwardly so as to retain the blade therein. Side walls 338 and base 336 form a channel 340. Blade members 336 are serrated or have teeth 344 formed thereon.

Where a blade member 326 passes through corner 334, there is provided an upper corner element 348 and a lower corner element 350. Upper corner element 348 includes a center portion 352 which is arranged to press on a blade member 326 as it goes through the corner. As upper corner element 348 is formed of a low friction material, this assists in the blade moving around the corner.

Figure 10:
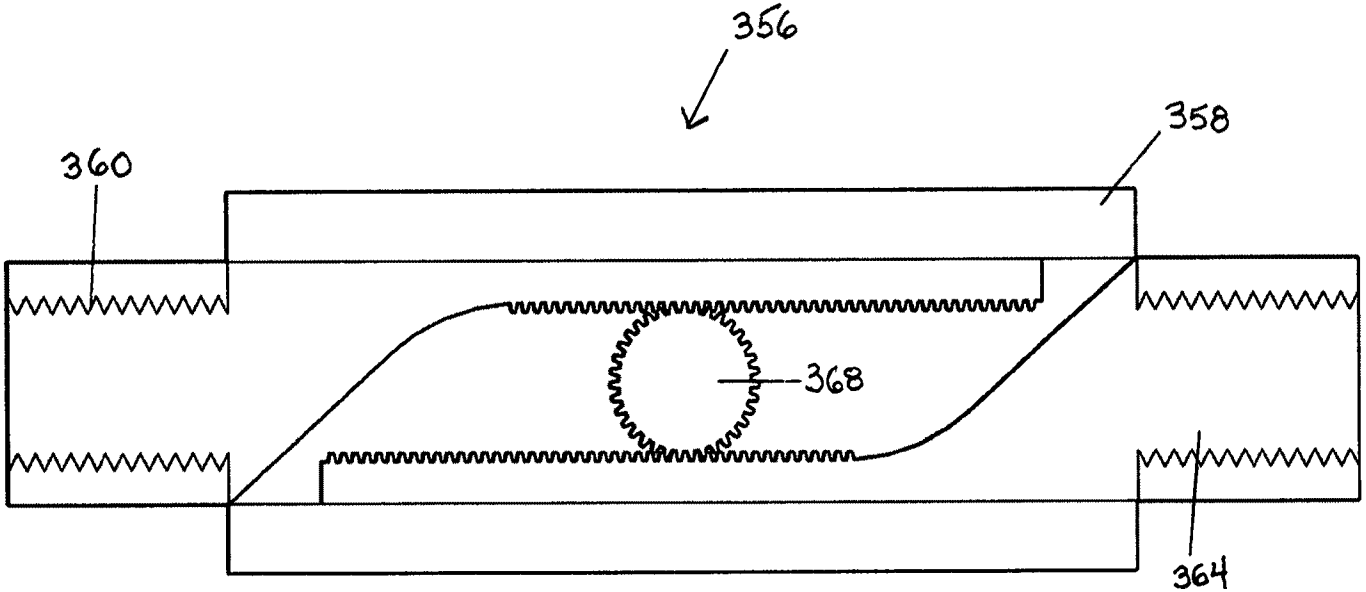
FIG. 10 is a plan view, partially in cutaway, of a reverser used in an awning window.
Figure 11:
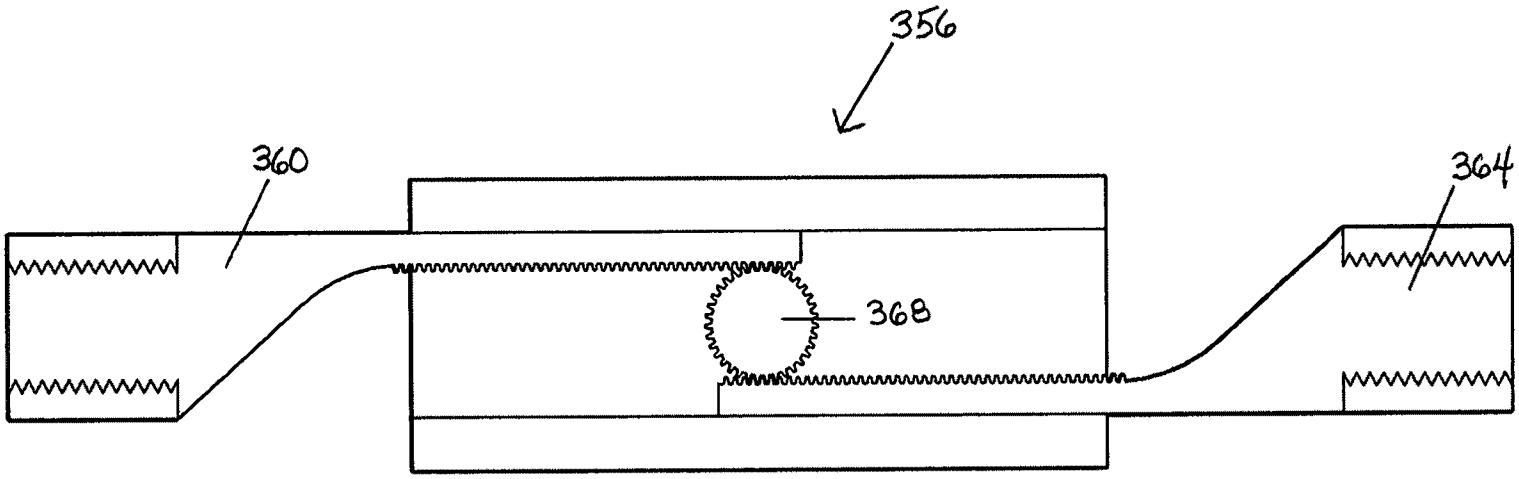
FIG. 11 is a view similar to FIG. 10 illustrating operation of the reverser.

As shown in FIGS. 10 and 11, when utilizing an awning type window which is hinged on both sides, it is desirable to have a locking mechanism on each side. Naturally, it is further desired that a single motion be utilized for locking both sides. Still further, it is desirable that the locking movement be in the same direction—to lock the mechanism would move vertically upwardly and to unlock, would move vertically downwardly. According to an embodiment of the present invention, this is achieved by use of a reverser generally designated by reference numeral 356. Reverser 356 has a housing 358. A first blade member 360 extends to a first side. First blade member 360 has a base 362 and side walls 364 which have teeth 366 formed thereon. A portion of the blade has teeth and is operated by a rotatable cog wheel 368. On the other side, there is provided a second blade member 360' which also has a base 362' and side walls 364' with teeth 366' engaging with teeth on rotatable cog wheel 368.

Figure 12B:
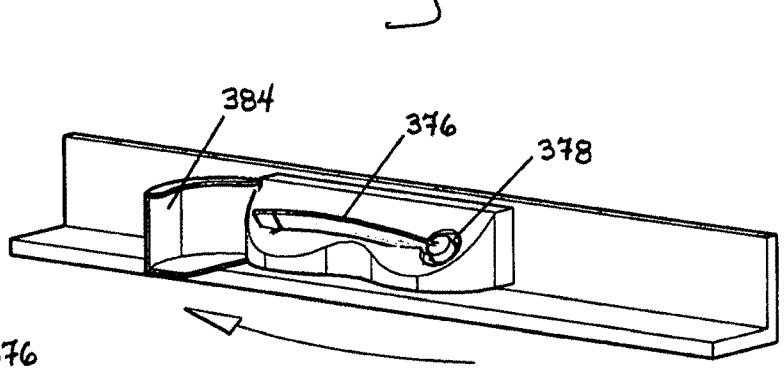
FIGS. 12A, B and C illustrate operation of the actuator and handle.
Figure 12A:
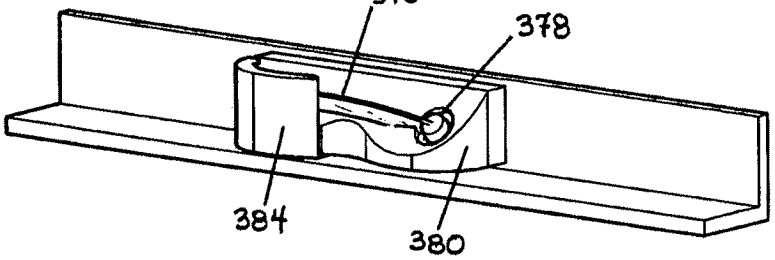
Figure 12C:
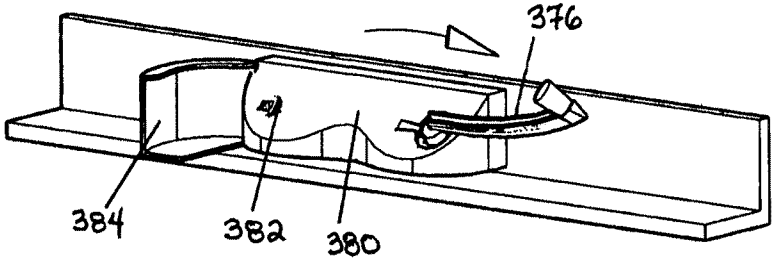
Figures 13A, 13B, 13C, 13D:
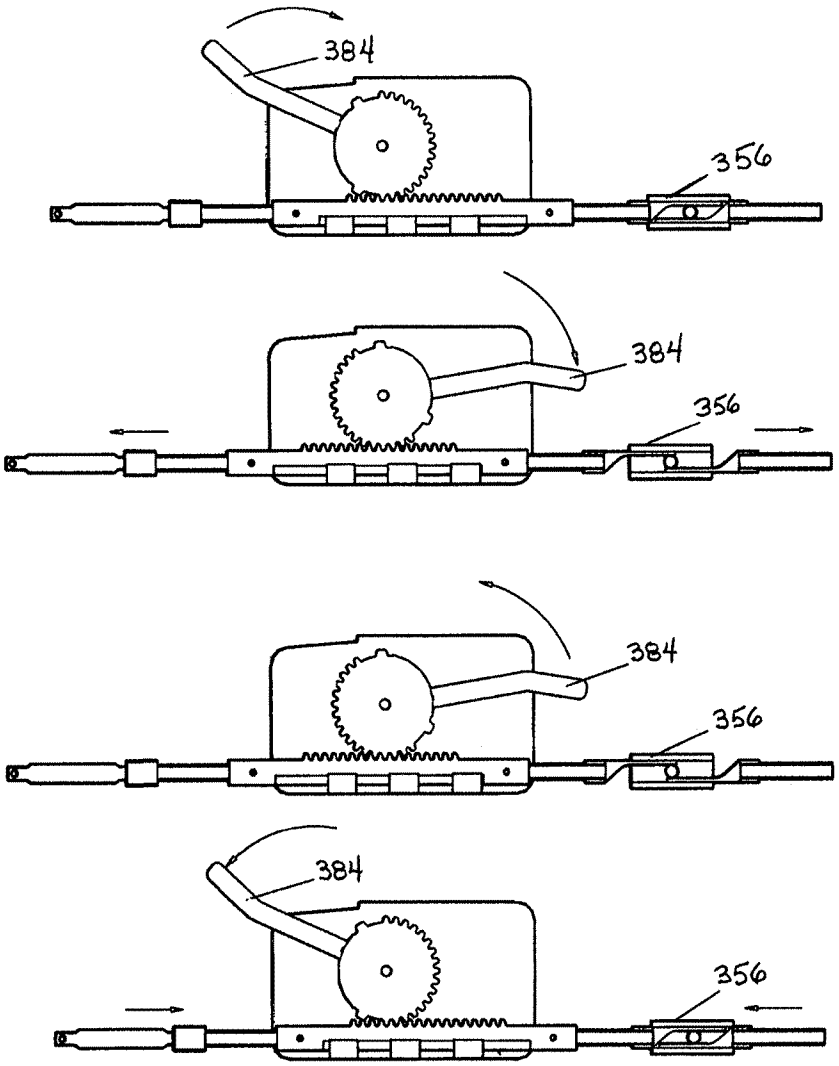
FIGS. 13A, B, C and D are top views thereof.

In the embodiment shown as FIGS. 12A, B, C and 13A, B, C and D, an arrangement is provided whereby the window must be unlocked before it can be opened. To this end, there is provided a handle 376 mounted to a base 378 in a pivotable manner. Housing 380 has a recess 382 therein such that the handle, which is used to open or close the window, can be moved from a first position wherein it is retained partially within recess 382 in housing 380. An actuator 384, when used to lock the window, is moved to the position illustrated in FIG. 12A. As indicated by arrow 386, actuator 384 must be moved to unlock the window to gain access to handle 376.

Figure 14:
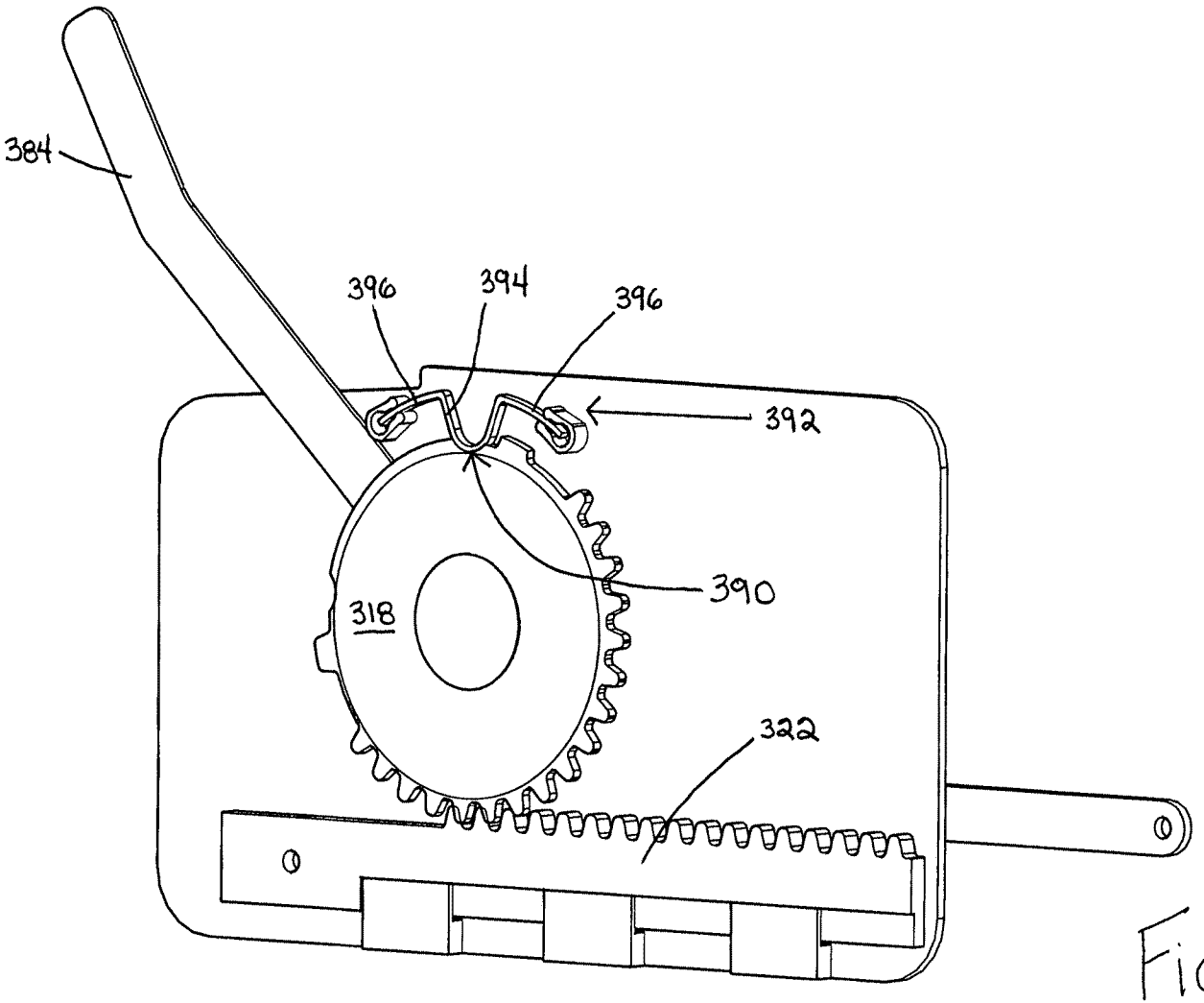
FIG. 14 is a plan view of a further embodiment.

In the embodiment of FIG. 14, there is provided a mechanism to maximize security if the locking mechanism is tampered with from the outside. A recess 390 is formed in pinion gear 318. A cantilever spring 392 having a head 394 and legs 396 is arranged such that head 394 will fit within recess 390 when in a fully locked position. This provides additional resistance to tampering with the locking mechanism from the outside of the window while actuator 384 can provide sufficient leverage to easily move spring head 394 from recess 390.

It will be understood that the above described embodiments are for purposes of illustration only and that changes and modifications may be made thereto without departing from the spirit and scope of the invention.

I claim:

1. An operator for a window comprising:

a base designed to be attached to a window sash;

an arm having first and second ends, said first end being secured to said base, said first end of said arm having a worm wheel formed thereon;

a shaft having a worm operatively connected to said worm wheel;

a handle secured to said shaft;

a locking mechanism comprising a multipoint tie bar; and an actuator connected to a rack and pinion gear to move said multipoint tie bar between open and locked positions, said pinion gear including a recess formed therein, a spring member mounted on said base, said spring member engaging within said recess on said pinion gear when said locking mechanism is in a locked position.

2. An operator for a window comprising:

a base designed to be attached to a window sash;

an arm having first and second ends, said first end being secured to said base, said first end of said arm having a worm wheel formed thereon;

a shaft having a worm operatively connected to said worm wheel;

a handle secured to said shaft;

a locking mechanism comprising a blade, a guide mounted on said sash, said blade being movable within said guide; and an actuator connected to said blade to move said blade between open and locked positions, said actuator, when in said locked position, preventing access to said handle, said actuator, when moved to said open position, allowing access to said handle.

3. The operator of claim 2 wherein said handle is foldable into said base, said actuator overlying said handle when said handle is folded into said base.

4. An operator for a window comprising a base member designed to be attached to a window sash;

a window opening mechanism mounted on top of said base member, a window locking mechanism mounted below said base member;

said window opening mechanism comprising an arm having first and second ends, said first end being secured to said base member, said first end of said arm having a worm wheel formed thereon;

a shaft having a worm operatively connected to said worm wheel;

a handle secured to said shaft;

said window locking mechanism comprising a multipoint tie bar; and an actuator connected to a rack and pinion gear arrangement to move said multipoint tie bar between open and locked positions, wherein said actuator, when in said locked position, prevents access to said handle, said actuator, when moved to said open position, allowing access to said handle.

5. The operator of claim 4 wherein said pinion gear includes a recess formed therein, a spring member mounted on said base member, said spring member engaging within said recess when said locking mechanism is in a locked position.

6. The operator of claim 5 wherein said locking mechanism comprises a blade, a guide mounted on said sash, said blade being movable within said guide, said guide having a channel formed therein, a corner portion extending between a window frame bottom wall and a window frame side wall, said blade deflector being located at said corner portion, said blade deflector having a portion contacting a top surface of said blade to deflect said blade inwardly to thereby prevent contact between said blade and said guide, said deflector being formed of a low friction material.

7. An operator for a window comprising a base member designed to be attached to a window sash;

a window opening mechanism mounted on top of said base member, a window locking mechanism mounted below said base member;

said window opening mechanism comprising an arm having first and second ends, said first end being secured to said base member, said first end of said arm having a worm wheel formed thereon;

a shaft having a worm operatively connected to said worm wheel;

a handle secured to said shaft;

a locking mechanism comprising a blade, a guide mounted on said sash, said blade being movable within said guide;

said window locking mechanism comprising a multipoint tie bar; and an actuator connected to a rack and pinion gear arrangement to move said multipoint tie bar between open and locked positions; and wherein said guide has a channel formed within said guide, a corner portion extending between a window frame bottom wall and a window frame side wall, a blade deflector located at said corner portion, said blade deflector having a portion contacting a top surface of said blade to deflect said blade inwardly to thereby prevent contact between said blade and said guide, said deflector being formed of a low friction material.

8. The operator of claim 7 wherein said blade deflector is secured to one of said window frame bottom wall and said window frame side wall.

9. An operator for a window comprising a base member designed to be attached to a window sash;

a window opening mechanism mounted on top of said base member, a window locking mechanism mounted below said base member;

said window opening mechanism comprising an arm having first and second ends, said first end being secured to said base member, said first end of said arm having a worm wheel formed thereon;

a shaft having a worm operatively connected to said worm wheel;

a handle secured to said shaft;

a locking mechanism comprising a blade, a guide mounted on said sash, said blade being movable within said guide;

said window locking mechanism comprising a multipoint tie bar; and an actuator connected to a rack and pinion gear arrangement to move said multipoint tie bar between open and locked positions; and wherein said guide extends along a portion of a window side wall, a channel formed within said guide, said blade having a locking projection extending therefrom, and an extension arm connected between said blade and said operator, said extension arm having a plurality of teeth, said teeth merging with teeth on said blade member, the arrangement being such that said extension arm may be cut to a desired length.

10. An operator for a window comprising a base member designed to be attached to a window sash;

a window opening mechanism mounted on top of said base member, a window locking mechanism mounted below said base member;

said window opening mechanism comprising an arm having first and second ends, said first end being secured to said base member, said first end of said arm having a worm wheel formed thereon;

a shaft having a worm operatively connected to said worm wheel;

a handle secured to said shaft;

a locking mechanism comprising a blade, a guide mounted on said sash, said blade being movable within said guide;

said window locking mechanism comprising a multipoint tie bar; and an actuator connected to a rack and pinion gear arrangement to move said multipoint tie bar between open and locked positions; and wherein said guide extends along a portion of said window frame bottom wall and along a portion of each of said window frame side walls, a locking projection extending from respective ends of said blade, a reversing mechanism comprising a rotatable cog wheel, said cog wheel engaging with said blade portions having teeth thereon, the arrangement being such that said blade operates in a single vertical direction when locking or unlocking along each of said window frame side walls.

* * * * *